US007898517B2

(12) United States Patent
Umeda et al.

(10) Patent No.: US 7,898,517 B2
(45) Date of Patent: Mar. 1, 2011

(54) DISPLAY DEVICE, DATA DRIVER IC, AND TIMING CONTROLLER

(75) Inventors: Kengo Umeda, Kanagawa (JP); Yoshihiko Hori, Kanagawa (JP); Takashi Nose, Kanagawa (JP); Hirobumi Furihata, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 944 days.

(21) Appl. No.: 11/559,703

(22) Filed: Nov. 14, 2006

(65) Prior Publication Data

US 2007/0263017 A1 Nov. 15, 2007

(30) Foreign Application Priority Data

Nov. 15, 2005 (JP) ..... 2005-329710

(51) Int. Cl.
*G09G 3/36* (2006.01)

(52) U.S. Cl. ..... 345/98

(58) Field of Classification Search ..... 345/98–100
See application file for complete search history.

(56) References Cited

U.S. PATENT DOCUMENTS 4,396,938 A * 8/1983 Dischert ..... 348/674
4,786,968 A * 11/1988 Kutner ..... 348/674
7,205,970 B2 4/2007 Kim et al.
2001/0033260 A1* 10/2001 Nishitani et al. ..... 345/87
2005/0200761 A1* 9/2005 Fukue et al. ..... 348/674
2005/0219189 A1* 10/2005 Fukuo ..... 345/96

FOREIGN PATENT DOCUMENTS

CN 1404029 A 3/2003
JP 5-216430 A 8/1993
JP 09288468 A * 11/1997
JP 2004-163946 A 6/2004

* cited by examiner

*Primary Examiner*—Ke Xiao
(74) *Attorney, Agent, or Firm*—Sughrue Mion, PLLC

(57) ABSTRACT

A display device includes a display panel, a data line driving circuit, a timing control unit and a parameter output unit. The data line driving circuit drives data lines on the display panel. The timing control unit outputs an input gradation signal based on an image signal to the data line driving circuit at a predetermined timing. The parameter output unit outputs a conversion parameter for executing gamma correction corresponding to characteristics between a driving voltage and a luminance of the display panel. The data line driving circuit includes: a correction circuit which converts the input gradation signal to an output gradation signal based on the conversion parameter and outputs the converted signal, and a D/A conversion circuit which converts the output gradation signal to a data line driving signal of an analog signal and drive the data lines.

4 Claims, 13 Drawing Sheets

Fig. 4

21

210 211

| INPUT GRADATION SIGNAL($D_{in}j$) 10bit ADDRESS IN LUT | OUTPUT GRADATION SIGNAL ($D_{out}j$) 12bit CORRECTION DATA |
|---|---|
| 0 | 0 |
| 1 | 4 |
| 2 | 7 |
| · | · |
| · | · |
| · | · |
| 1022 | 4030 |
| 1023 | 4095 |

DISPLAY DEVICE, DATA DRIVER IC, AND TIMING CONTROLLER

BACKGROUND OF THE INVENTION

1. Field of the Invention

The present invention relates to a display device in which a timing controller, a plurality of data driver ICs, a scanning line driving circuit and a display panel are provided separately. More particularly, the present invention relates to a display device, a data driver and a timing controller for conducting a multi gradation display by a voltage modulation method using a DA converter.

2. Description of the Related Art

Video signals of an image televised in an ordinary television broadcast are transmitted through a γ (gamma) correction which is consistent with IT (current-luminance) characteristics of a cathode ray tube (CRT). Accordingly, in the case of displaying the above video signals as an image in a display device other than the CRT, it is necessary to make a gradation correction (hereinafter referred to as γ correction) corresponding to the characteristics between the driving voltage and the luminance in the display device. This γ correction enables the luminance of a liquid crystal to be subjected to signal processing so as to be consistent with the level of original video signals initially generated, and allows precise reproduction of the contrast of an original image. In the case of a color screen, the above γ correction is also made for each of three primary colors individually so that fidelity reproduction of the hues of the original image is realized and color temperature setting and white balance adjustment are achieved by adjusting γ correction values. Meanwhile, data which was subjected to the γ correction has a tendency to increase the number of bit in comparison with the original data.

FIG. 1C is a graph showing V-T characteristics between a driving voltage and a luminance in a conventional liquid crystal panel. The vertical axis indicates the luminance (normalized, %), and horizontal axis indicates the data line driving signal (voltage). The characteristics between the driving voltage and the luminance in the liquid crystal panel are nonlinear as shown in FIG. 1C. Therefore, gradation data inputted as the video signals needs to be corrected as nonlinear driving voltages. In a general liquid crystal display device, they have been converted to analog voltages (driving voltages) by a nonlinear DA converter (DAC) in accordance with the characteristics between the driving voltage and the luminance in the liquid crystal panel. However, in recent years, liquid crystal display devices using a linear DAC (linear DA converter) for converting digital data to linear analog voltages as shown in FIG. 1B have been developed. Here, FIG. 1B is a graph showing conversion characteristics in the DAC in the conventional liquid crystal panel. The vertical axis indicates the data line driving signal (voltage), and horizontal axis indicates the output gradation signal (bit). In a liquid crystal display device using the linear DAC, gradation data is converted by using a look up table (LUT), and the converted data (hereinafter referred to as correction data) is subjected to DA conversion so as to obtain a driving voltage appropriate to the V-T characteristics. The correction data indicates nonlinear correction curves as shown in FIG. 1A so as to obtain the driving voltage in accordance with the V-T characteristics shown in FIG. 1C. Here, FIG. 1A is a graph showing correction curves indicated by the correction data in the conventional liquid crystal panel. The vertical axis indicates output gradation signal (bit) and the horizontal axis indicates input gradation signal (bit). Therefore, the digital data inputted to the LUT is required to be converted to the correction data with the large number of bit.

Japanese Laid-Open Patent Application JP-P2004-163946A discloses a display device for executing the γ correction by converting inputted digital gradation data to the correction data using the LUT. According to the display device disclosed in JP-P2004-163946A, the LUT is provided in a timing controller (TCON) for controlling a data line driving circuit which drives data lines on the display panel. The number of bit of the correction data converted by using the LUT becomes larger than the number of bit of the video signal inputted to the LUT, thereby the number of lines of a bus between the TCON and the data line driving circuit is increased in comparison with the number of lines of a bus between the TCON and an input source of the video signals. In the case of a serial transmission, the number of bit for the serial transmission is also increased, which results in high shift frequency.

Meanwhile, Japanese Laid-Open Patent Application JP-A-Heisei, 5-216430 discloses a liquid crystal display device for executing the gamma correction by installing the LUT in the data line driving circuit.

FIG. 2 is a block diagram showing the configuration of a liquid crystal display device according to the conventional technique. In this conventional technique, the LUT is installed in the data line driving circuit. Referring to FIG. 2, the liquid crystal display device according to the conventional technique includes a liquid crystal panel 11, a data line driving circuit 12, a scanning line driving circuit 13, and a timing controller (TCON) 14. The data line driving circuit 12 drives data lines on the liquid crystal panel 11. The scanning line driving circuit 13 drives scanning lines on the liquid crystal panel 11. The timing controller (TCON) 14 makes the liquid crystal panel 11 display images by controlling the data line driving circuit 12 and the scanning line driving circuit 13. The TCON 14 outputs an input gradation signal $D_{in}^{j}$ of 10 bits to data driver ICs $\mathbf{120}_1$ to $\mathbf{120}_n$ in the data line driving circuit 12 via a bus 17 on the basis of a video signal $D_{in}$ of 10 bits inputted from an outside. LUTs $\mathbf{121}_1$ to $\mathbf{121}_n$ respectively provided in the data drivers ICs $\mathbf{120}_1$ to $\mathbf{120}_n$ convert the input gradation signal $D_{in}^{j}$ into output gradation data $D_{out}^{j}$ of 12 bits, and output the output gradation data $D_{out}^{j}$ to latches $\mathbf{122}_1$ to $\mathbf{122}_n$, respectively. Each of the latches $\mathbf{122}_1$ to $\mathbf{122}_n$ latches the output gradation data $D_{out}^{j}$ for the number of outputs of a driving signal D outputted from corresponding one of DACs $\mathbf{123}_1$ to $\mathbf{123}_n$. Then, each of the latches $\mathbf{122}_1$ to $\mathbf{122}_n$ outputs the output gradation data $D_{out}^{j}$ to corresponding one of the DACs $\mathbf{123}_1$ to $\mathbf{123}_n$ in response to a latch signal 202 outputted from the TCON 14. Each of the DAC $\mathbf{123}_1$ to $\mathbf{123}_n$ conducts DA conversion for a signal $D_{out}$ outputted from corresponding one of the latches $\mathbf{122}_1$ to $\mathbf{122}_n$ so as to drive the data lines on the liquid crystal panel 11.

The following fact has now been discovered. As the display device disclosed in of JP-P2004-163946A, in the liquid crystal display device incorporating the LUT inside the TCON, the number of lines in the bus between the TCON and the data line driving circuit becomes larger, which results in the circuit area to be expanded. In the case of serial transmission, shift frequency becomes higher that causes the increase in power consumption and EMI.

Meanwhile, the characteristics between the driving voltage and the luminance in a liquid crystal panel used for a liquid crystal display device are made different by manufacturers, individual panel properties, or usage environment such as temperatures and brightness. However, according to the display device described in JP-A-Heisei, 5-216430, since correction characteristics (correction curves) provided by the LUT are constant or can not be arbitrarily changed, it is required to prepare a data driver IC having specific characteristics in each liquid crystal panel. Furthermore, it is impossible to change characteristics of the LUT and DAC after preparing a chip. Therefore, in the case of causing a difference between the characteristics of a liquid crystal panel and that stored in the chip, particularly a difference with respect to characteristics (correction curves) that are made different in the respective colors (RGB) as shown in FIG. 1A, a fine adjustment can not be allowed for correcting the difference.

SUMMARY OF THE INVENTION

In order to achieve an aspect of the present invention, the present invention provides a display device including: a display panel; a data line driving circuit configured to drive data lines on the display panel; a timing control unit configured to output an input gradation signal based on an image signal from outside to the data line driving circuit at a predetermined timing; and a parameter output unit configured to output a conversion parameter for executing gamma correction corresponding to characteristics between a driving voltage and a luminance of the display panel, wherein the data line driving circuit includes: a correction circuit configured to convert the input gradation signal to an output gradation signal based on the conversion parameter, and output the output gradation signal, and a digital-to-analog conversion circuit configured to convert the output gradation signal outputted from the correction circuit to a data line driving signal of an analog signal, and drive the data lines.

In the display device according to the present invention, a gamma correction, which is optimal to characteristics of the display panel, can be executed by changing the conversion parameter. The data transmission amount between the timing control unit and the data line driving circuit can be reduced in comparison with a display device in which a LUT is included in a timing control unit. Therefore, in the case that the input gradation signal supplied from the timing control unit is parallel data, a bus width between the timing control unit and the data line driving circuit can be reduced. In the case that the input gradation signal is serial data, the shift frequency generated among the input gradation signals can be reduced.

BRIEF DESCRIPTION OF THE DRAWINGS

The above and other objects, advantages and features of the present invention will be more apparent from the following description taken in conjunction with the accompanying drawings, in which:

FIG. 4 is a table showing an example of the configuration of an LUT according to the present invention;

DESCRIPTION OF THE PREFERRED EMBODIMENTS

Figure 1A:
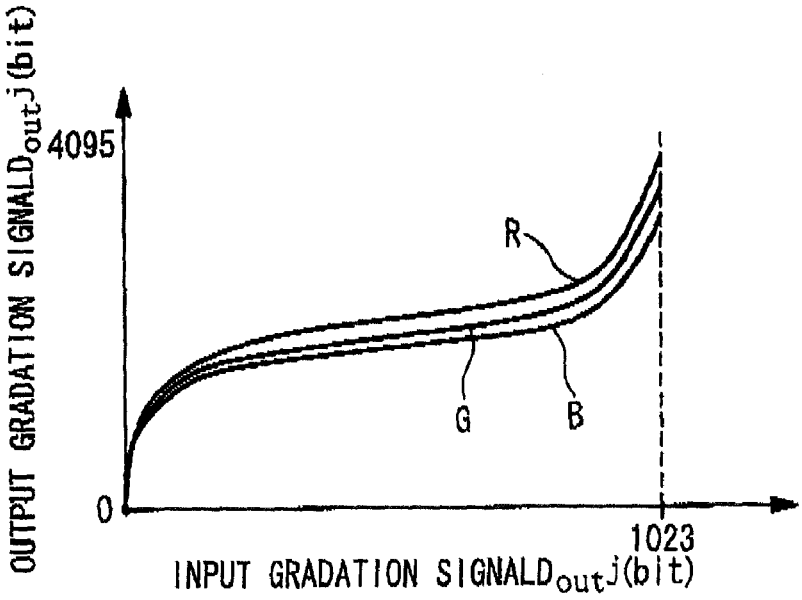
Fig. 1A PRIOR ART
FIG. 1A is a graph showing correction curves indicated by correction data in a conventional liquid crystal panel.
Figure 1B:
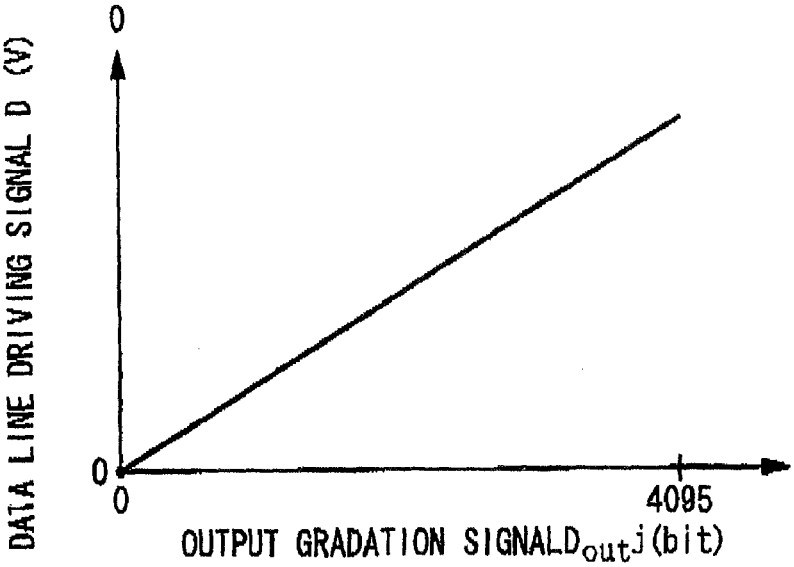
Fig. 1B PRIOR ART
FIG. 1B is a graph showing conversion characteristics in a DAC in a conventional liquid crystal panel.

The invention will be now described herein with reference to illustrative embodiments. Those skilled in the art will recognize that many alternative embodiments can be accomplished using the teachings of the present invention and that the invention is not limited to the embodiments illustrated for explanatory purposed.

Embodiments of a display device, a data driver and a timing controller according to the present invention will be described below with reference to the attached drawings. In the drawings, same or similar reference letters are meant to have the same, similar or equivalent configuration elements. In the case of having a plurality of similar configurations, the reference letters indicating the configurations are provided with subscripts.

1. First Embodiment

Figure 3:
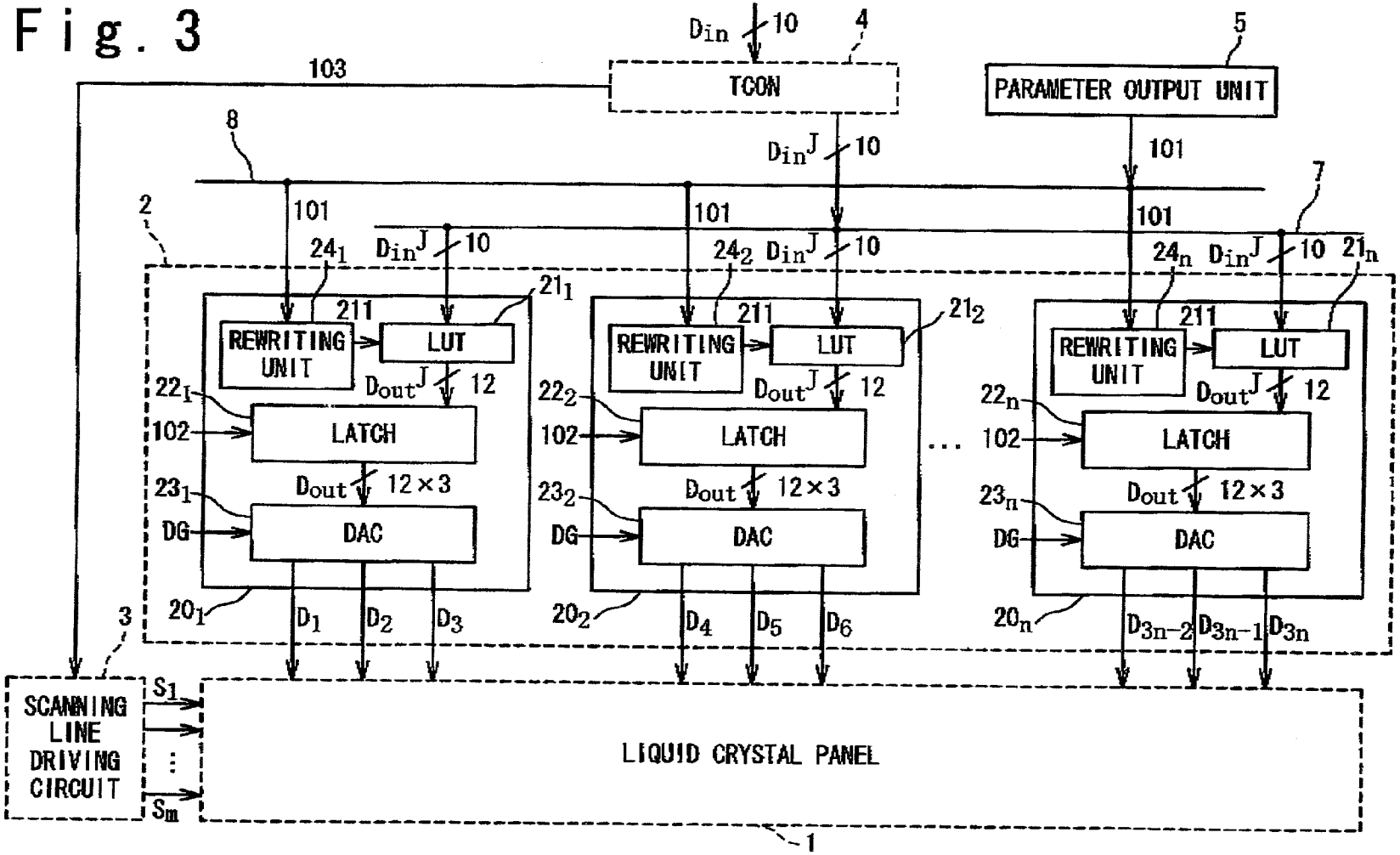
FIG. 3 is a block diagram showing the configuration of a liquid crystal display device according to a first embodiment of the present invention.

FIG. 3 is a block diagram showing a configuration of a liquid crystal display device according to the first embodiment of the present invention. Referring to FIG. 3, the liquid crystal display device according to the present invention includes a liquid crystal panel 1, a data line driving circuit 2, a scanning line driving circuit 3, a timing control unit (TCON) 4, a parameter output unit 5, and a gradation voltage generating circuit (not shown). On the liquid crystal panel 1, there are provided a plurality of data lines (here, 3n number of data lines) arranged in the column direction, a plurality of scanning lines (here, m number of scanning lines) arranged in the row direction, and pixels including a TFT and a liquid crystal capacity arranged in regions where the data lines are crossed with the scanning lines. A gate electrode of the TFT in each of the pixels on the liquid crystal panel 1 is connected to one of the scanning lines, and a drain electrode of the TFT is connected to one of the data lines. The TFT in the pixel on the liquid crystal panel 1 is turned on by a scanning line driving signal S outputted from the scanning line driving circuit 3, and a display signal is written in a liquid crystal capacity of the pixel by a data line driving signal D outputted from the data line driving circuit 2. The TCON 4 and the data line driving circuit 2 according to the present invention are connected via a bus 7 with a bus width of 10 so that parallel data of 10 bits can be transmitted. Although the present embodiment shows an example of a parallel data transmission in the bus line width of 10, a serial data transmission which is capable of decreasing the bus line width may be applied. The parameter output unit 5 is connected to the data line driving circuit 2 via a bus 8.

The TCON 4 controls the data line driving circuit 2 and the scanning line driving circuit 3, thereby a desired image is displayed on the liquid crystal panel 1. The TCON 4 receives a video signal $D_{in}$ from an image drawing LSI (not shown) such as, for example, a central processing unit (CPU) and a digital signal processor (DSP), and the received video signal $D_{in}$ is transferred to the data line driving circuit 2. The video signal $D_{in}$ here is the digital data of 10 bits which instructs gradations of the respective pixels in the liquid crystal panel 1. When the TCON 4 transfers the video signal $D_{in}$ to the data line driving circuit 2, the video signal $D_{in}$ corresponding to each of RGB colors in the respective pixels is transferred to the data line driving circuit 2. In the following explanation, the video signal $D_{in}$ corresponding to a color (R) transferred to the data line driving circuit 2 is indicated as an input gradation signal $D_{in}^{R}$, the video signal $D_{in}$ corresponding to a color (G) is indicated as an input gradation signal $D_{in}^{G}$, and the video signal $D_{in}$ corresponding to a color (B) is indicated as an input gradation signal $D_{in}^{B}$, so that they are indicated as an input gradation signal $D_{in}^{j}$ (j is one of R, G and B) below.

The TCON 4 receives a vertical synchronizing signal, a horizontal synchronizing signal, a data enable signal, a dot clock signal, and other control signals from the image drawing LSI (not shown), so as to provide the data line driving signal 2 with a latch signal 102 and to provide the scanning line driving signal 3 with a scanning line driving control signal 103 on the basis of these control signals. The data line driving circuit 2 outputs data line driving signals $D_1$ to $D_{3n}$ to each of the data lines in response to the latch signal 102, and drives the data lines, respectively. The scanning line driving circuit 3 outputs scanning line driving signals $S_l$ to $S_m$ to each of the scanning lines in response to the scanning line driving control signal 103, respectively.

The data line driving circuit 2 in the liquid display device represented by a liquid crystal television and the like includes a plurality of data driver ICs $\mathbf{20}_l$ to $\mathbf{20}_n$. Here, the plurality of data driver ICs $\mathbf{20}_l$ to $\mathbf{20}_n$ is integrated on a semiconductor substrate in which the upper limit of a tip size is restricted for convenience of a semiconductor manufacturing device. Each of the data driver ICs $\mathbf{20}_l$ to $\mathbf{20}_n$ outputs the data line driving signal D on the basis of the input gradation signal $D_{in}^{j}$ in response to the latch signal 102 supplied from the TCON4, so as to drive the data lines on the liquid crystal panel 1. A data driver IC 20 in the present embodiment drives three data lines corresponding to the colors R, G and B respectively, and drives 3n number of data lines as the entire data line driving circuit 2. In the present embodiment, for convenience of explanation, the number of the data lines driven by a data driver IC 20 was made to be three, but there is no limitation for these numbers and arbitrary setting may be possible.

The output unit 5 outputs a look up table (LUT) setting parameter 101 to each of data driver ICs $\mathbf{20}_l$ to $\mathbf{20}_n$ in the data driver circuit 2 via the bus 8. Each of the data driver ICs $\mathbf{20}_l$ to $\mathbf{20}_n$ changes the setting of an LUT 21 to be described below on the basis of the LUT setting parameter 101. The output unit 5 includes a memory (not shown) in which the LUT setting parameter 101 is recorded by an input from an external device. The output unit 5 may output the LUT setting parameter 101 in the memory to the data driver IC 20 in response to the input from the outside, or may periodically output the LUT setting parameter 101 in the memory.

The LUT setting parameter 101 here includes correction data 211 set for executing γ (gamma) correction on the input gradation signal $D_{in}^{j}$ and information specifying the input gradation signal $D_{in}^{j}$ corresponding to the correction data 211. For example, it includes the information relating the correction data 211 for executing the γ correction on the input gradation signal $D_{in}^{j}$ to an address 210 in the LUT 21 for storing the correction data 211. The correction data 211 included in the LUT setting parameter 101 is preferably set so that the relationship between a voltage of the data line driving signal D which is converted and outputted by a DAC 23 and a luminance of the liquid crystal panel is adjusted to characteristics between the driving voltage and the luminance (transmittance) of the liquid crystal panel 1 shown in FIG. 1C. That is, the correction data 211 is set so as to be adjusted to correction curves shown in FIG. 1A.

Referring to FIG. 3, the data driver IC 20 according to the present invention includes the look up table (LUT) 21, the latch 22, the digital-analog converter (DAC) 23, and a rewriting unit 24. In the following explanation, the LUT 21, the latch 22, the DAC 23, the rewriting unit 24 provided in the data driver IC 20*n* are indicated as an LUT 21*n*, a latch 22*n*, a DAC 23*n*, and a rewriting unit 24*n*. In the data driver IC 20, the input gradation signal $D_{in}^{j}$ of 10 bits supplied from the TCON 4 is converted to an output gradation signal $D_{out}^{j}$ of 12 bits in the LUT 21. The converted output gradation signal $D_{out}^{j}$ of 12 bits is outputted to the latch 22. The LUT 21 here has the correction data 211, and outputs the correction data 211 corresponding to the supplied input gradation signal $D_{in}^{j}$ as the output gradation signal $D_{out}^{j}$. The latch 22 latches the output gradation signal $D_{out}^{j}$ for the number of the data lines driven by the data driver IC 20. The latch 22 outputs, to the DAC 23, the latched output gradation signal $D_{out}^{j}$ for the number of the data lines that are driven as an output gradation signal $D_{out}$ in response to the latch signal 102 supplied from the TCON 4. The DAC 23 converts the output gradation signal $D_{out}$ received from the latch 22 to the data line driving signal D on the basis of a gradation voltage DG supplied from a gradation voltage output circuit (not shown). Then, the DAC 23 outputs the data line driving signal D to a predetermined data line, and drives the data lines. The rewriting unit 24 rewrites the correction data 211 in the LUT 21 on the basis of the LUT setting parameter 101 transferred from the parameter output unit 5.

The LUT 21 is a writable memory device (memory) exemplified by a resistor, an RAM and a rewritable nonvolatile memory and the like. The rewriting unit 24 refers to address information 210 included in the LUT setting parameter 101 supplied from the parameter output unit 5, and write (overwrite) the corresponding correction data 211 to the LUT 21. FIG. 4 is a table showing an example of the configuration of the LUT according to the present invention. Referring to FIG. 4, the LUT 21 stores the correction data 211 in the address 210 specified by the LUT setting parameter 101. The LUT 21 outputs the correction data 211 stored in the address 210 which is consistent with the supplied input gradation signal $D_{in}^{j}$ as the output gradation signal $D_{out}^{j}$.

Figure 1C:
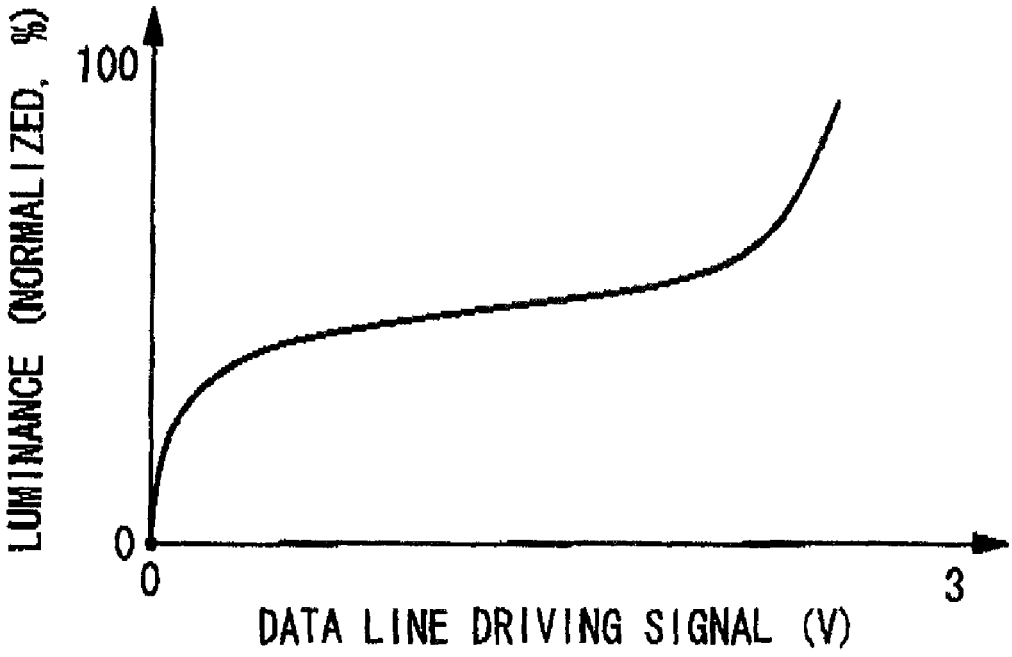
Fig. 1C PRIOR ART
FIG. 1C is a graph showing V-T characteristics between a driving voltage and a luminance in a conventional liquid crystal panel.
Figure 2:
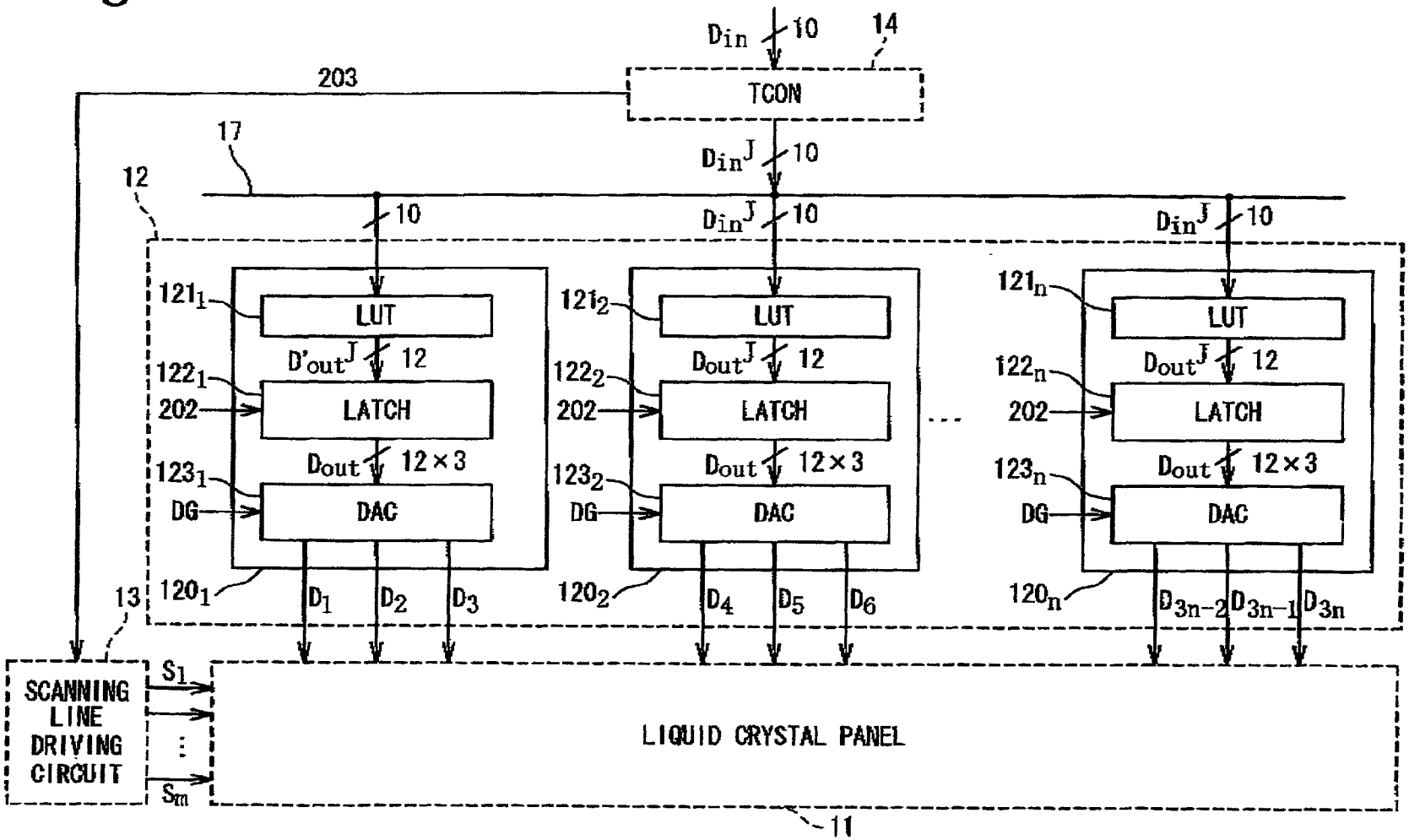
Fig. 2 PRIOR ART
FIG. 2 is a block diagram showing a configuration of a liquid crystal display device according to the conventional technique.

Moreover, as shown in FIG. 1A, because characteristics of the correction data 211 (output gradation signal $D_{out}^{j}$) for the input gradation signal $D_{in}^{j}$ corresponding to each of the R, G and B colors are different, the LUT 21 corresponding to each of the R, G and B colors is preferably provided in the data driver IC 20. In this case, identification information corresponding to each of the R, G and B colors is preferably included in the LUT setting parameter 101 so that the LUT 21 storing the different correction data for each of the colors can be selected. In this way, the LUT corresponding to each of the RGB colors is provided, thereby the γ correction can be made by corresponding to the characteristics between the driving voltage and the luminance in the liquid crystal panel 1 that are made different by the respective colors of the input gradation signal $D_{in}^{j}$. Since the γ correction is executed by rewriting the correction data 211 for each of the RGB colors, more precise corrections and video display with high color reproducibility can be achieved.

The latch 21 latches the output gradation signal $D_{out}^{j}$ of 12 bits supplied in the x dot unit for the number of the data lines (here, 12 bits×3 lines) that are driven, and outputs the output gradation signal $D_{out}^{j}$ to the DAC 23 as the output gradation signal $D_{out}$ in response to the supplied latch signal 102 (In this case, x is a positive integer determined by a bus line width of the bus 7). The DAC 23 converts the output gradation signal $D_{out}$ to the data line driving signal D of an analog signal so as to drive the data line. For example, the latch 21 latches output gradation signals $D_{out}^{R}$, $D_{out}^{G}$ and $D_{out}^{B}$ so as to output the output gradation signals $D_{out}^{R}$, $D_{out}^{G}$ and $D_{out}^{R}$ as the output gradation signal $D_{out}$ to the DAC 23 in response to the latch signal 102. The DAC 23 converts the output gradation signal $D_{out}$ received from the latch 22 to data line driving signals $D_1$, $D_2$ and $D_3$ on the basis of the supplied gradation voltage DG so as to output the data line driving signals $D_1$, $D_2$ and $D_3$ to the predetermined data lines respectively for driving the data lines.

Due to the above configuration, the γ correction is executed on the supplied video signal $D_{in}$ in the LUT 21 and the DAC 23 so as to drive the data lines on the liquid crystal panel 1 in the liquid crystal display device according to the present invention. The correction data 211 appropriate to the characteristics between the driving voltage and the luminance in the liquid crystal panel 1 is also written to the LUT 21 at arbitrary timing or periodically.

As described above, the liquid crystal display device according to the present invention incorporates the LUT 21 inside the data driver IC 20, so that the data transmission amount between the TCON 4 and the data line driving circuit 2 can be reduced. In the present embodiment, the number of lines in the bus 7 can be reduced from 12 to 10 in comparison with the case of incorporating the LUT inside the TCON. Therefore, the number of wiring can be reduced, which decreases the manufacturing cost. In the case of the serial transmission, the bit number for the serial transmission can also be reduced from 12 to 10, which realizes reduction of the shift frequency generated among the input gradation signals $D_{in}^{j}$ and the increase of the consumption power caused by the serial transmission can be suppressed.

Since the setting in the LUT 21 (correction data 211) can be changed by the parameter output unit 5, the γ correction corresponding to the characteristics between the driving voltage and the luminance in the liquid crystal panel 1 can be executed. Therefore, even if the difference occurs between the conversion characteristics in the setting and the characteristics in the relationship between the driving voltage and the luminance in the liquid crystal panel 1 after manufacturing the liquid crystal display device, fine adjustment of the γ correction can be easily realized by simply changing the correction data 211.

2. Second Embodiment

Figure 5:
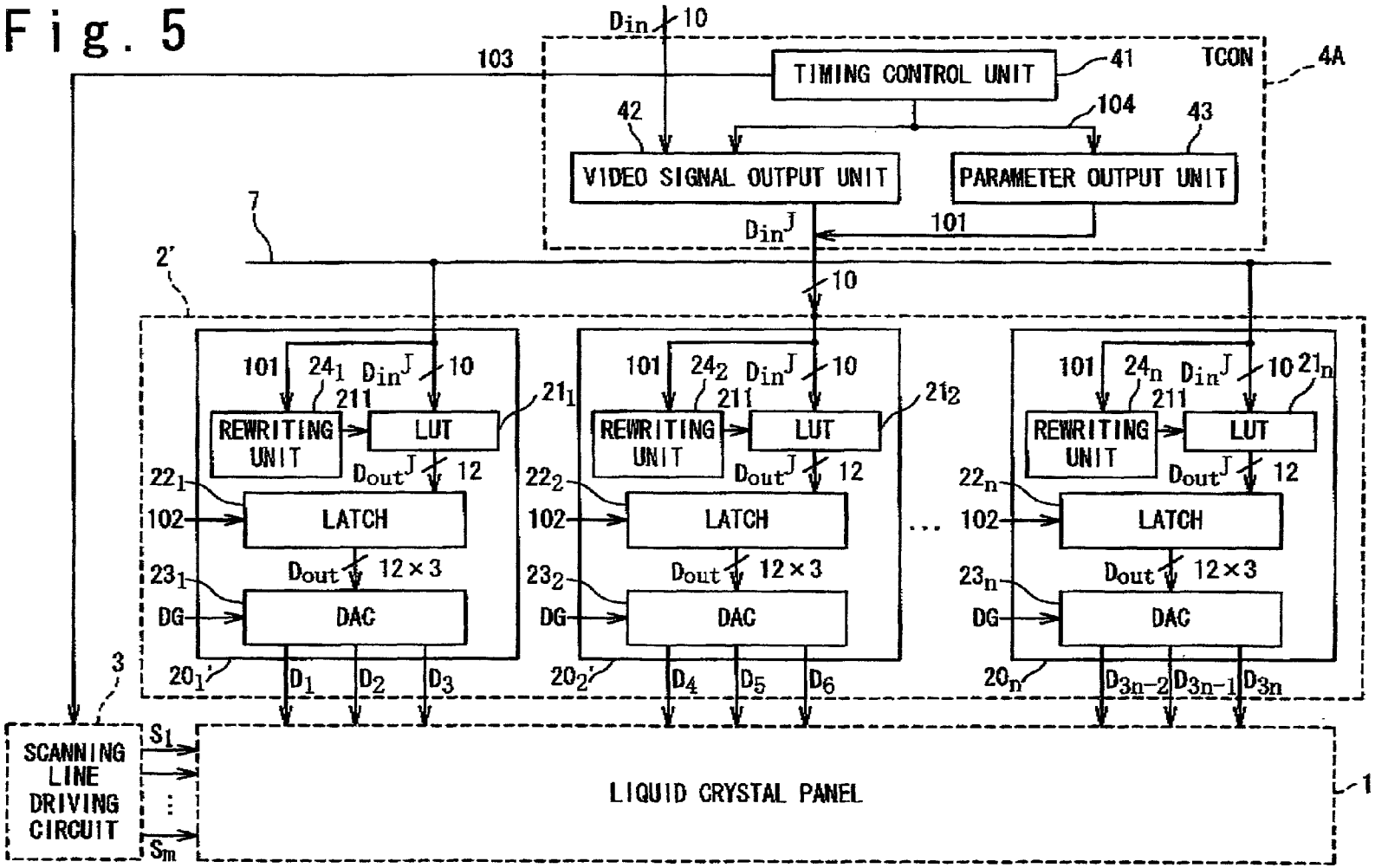
FIG. 5 is a block diagram showing the configuration of a liquid crystal display device according to a second embodiment of the present invention.

FIG. 5 is a block diagram showing the configuration of a liquid crystal display device according to a second embodiment of the present invention. The liquid crystal display device in the second embodiment includes a TCON 4A provided with a parameter output unit 43 in place of the TCON 4 in the first embodiment, in which the bus 8 for the LUT setting parameter is not provided. Referring to FIG. 5, the TCON 4A in the second embodiment includes a timing output unit 41, a video signal output unit 42 and a parameter output unit 43. The timing control unit 41 outputs a timing control signal 104 to the video signal output unit 42 and the parameter output unit 43 so as to control the video signal output unit 42 and the parameter output unit 43. The video signal output unit 42 includes a memory (not shown), stores a video data $D_{in}$ supplied from an image drawing circuit (not shown) in the memory, and outputs the input gradation signal $D_{in}^{j}$ of 10 bits to a data line driving circuit 2' via the bus 7 in response to the timing control signal 104. The parameter output unit 43 includes a memory (not shown) for storing the LUT setting parameter 101 and outputs the LUT setting parameter 101 in the memory to the data line driving circuit 2' via the bus 7 in response to the timing control signal 104. In a data driver IC 20' in the data line driving circuit 2', the correction data 211 of the LUT 21 is rewritten by the inputted LUT setting parameter 101.

Figure 6:
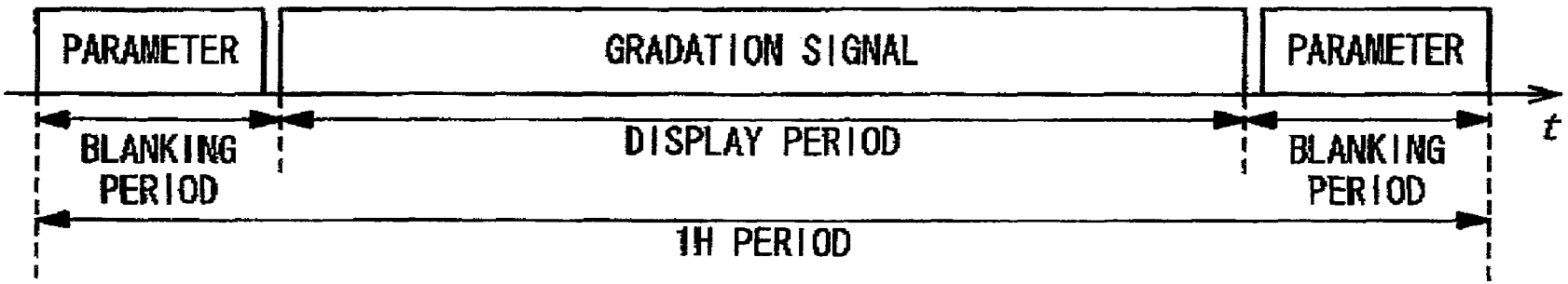
FIG. 6 is a timing chart of an LUT setting parameter and an input gradation signal outputted from a timing controller according to a second embodiment of the present invention.

FIG. 6 is a timing chart of the input gradation signal $D_{in}^{j}$ and the LUT setting parameter 101 to be supplied to the data line driving circuit 2' via the bus 7. Referring to FIG. 6, the parameter output unit 43 outputs the LUT setting parameter 101 in the blanking period of one horizontal period (1H period) in response to the timing control signal 104. In this way, the parameter output unit 43 is thus controlled by the timing control unit 41 and the LUT setting parameter 101 can be outputted in a period in which the input gradation signal $D_{in}^{j}$ is not outputted. Therefore, it is possible to superpose the input gradation signal $D_{in}^{j}$ with the LUT setting parameter 101 via the bus 7 for transfer to the data line driving circuit 2.

In the data driver IC 201 in the data line driving circuit 2' according to the present invention, the above configuration allows the correction data 211 in the LUT 21 to be rewritten by the LUT setting parameter 101 supplied via the same bus 7. Therefore, the number of bus lines can be reduced in comparison with the first embodiment. The parameter output unit 43 provided in the TCON 4A also enables the circuit area of the liquid crystal display device to be decreased in the second embodiment in comparison with the first embodiment. Furthermore, the correction data 211 in the LUT 21 can be changed in each horizontal period, which allows the γ correction to be executed by changing the optimum correction data 211 in each one line. Alternatively, the LUT parameter 101 is outputted in the blanking period of the vertical period so as to execute the γ correction by changing the optimum correction data 211 in each frame.

3. Third Embodiment

Figure 7:
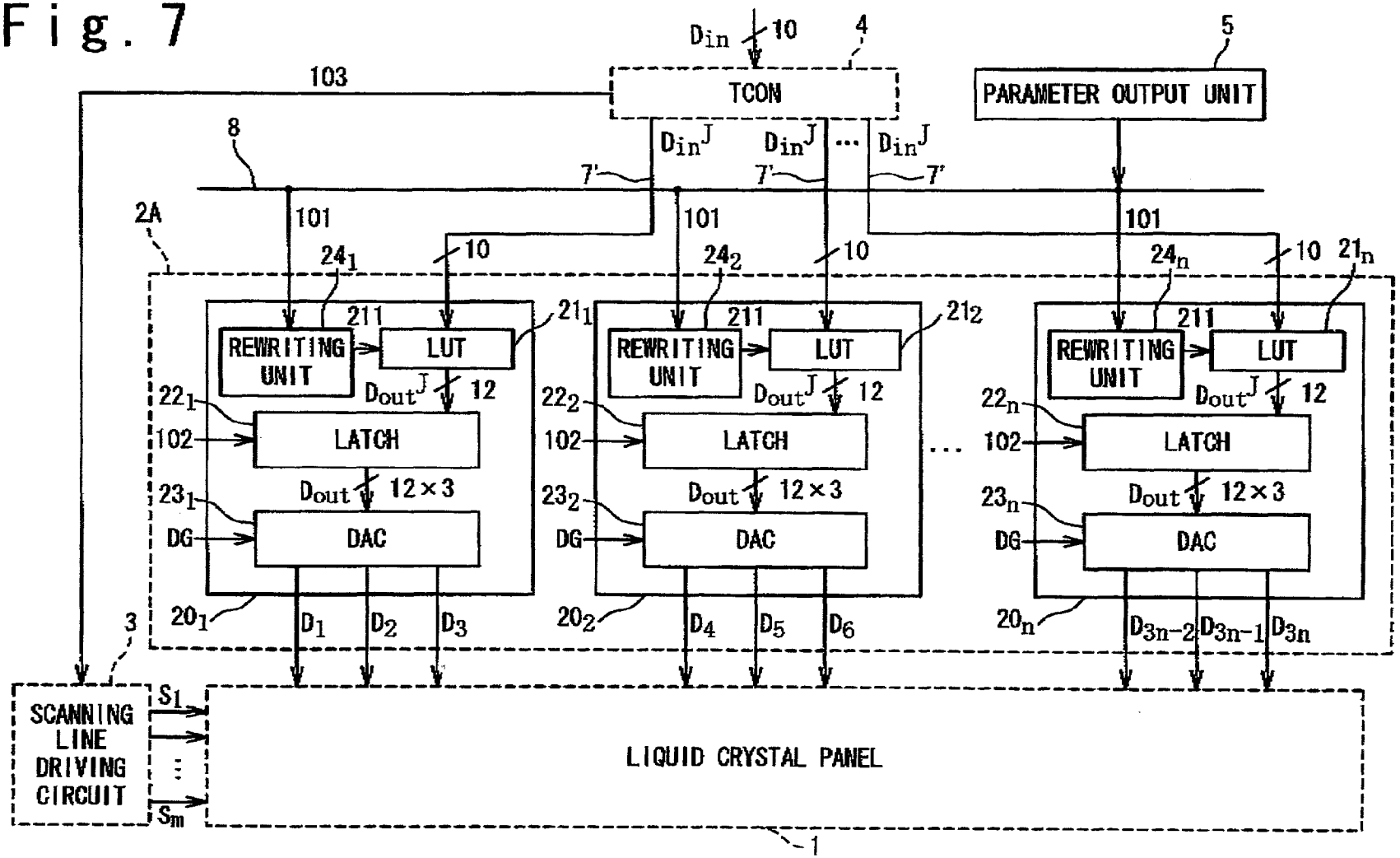
FIG. 7 is a block diagram showing the configuration of a liquid crystal display device according to a third embodiment of the present invention.

FIG. 7 is a block diagram showing the configuration of a liquid crystal display device according to a third embodiment of the present invention. This configuration is different from the configuration in the first embodiment in the point that the TCON 4 is connected to the data driver ICs $\mathbf{20}_1$ to $\mathbf{20}_n$ in one-to-one correspondence by using a bus 7'. That is, referring to FIG. 7, the liquid crystal display device according to the present invention is configured to wire the bus 7' between the TCON 4 and each of the data driver ICs $\mathbf{20}_1$ to $\mathbf{20}_n$ in the data line driving circuit 2A in one-to-one correspondence in place of the bus 7 in the first embodiment. Due to this configuration, the TCON 4 is capable of outputting the input video signal $D_{in}^{j}$ to each of the data driver ICs $\mathbf{20}_1$ to $\mathbf{20}_n$ simultaneously. Therefore, the data processing time spent for one data driver IC 20 can be extended. In the present embodiment, a configuration of excluding the parameter output 5 and the bus 8 and replacing the TCON 4 with the TCON 4A described in the second embodiment may also be applied.

4. Fourth Embodiment

Figure 8:
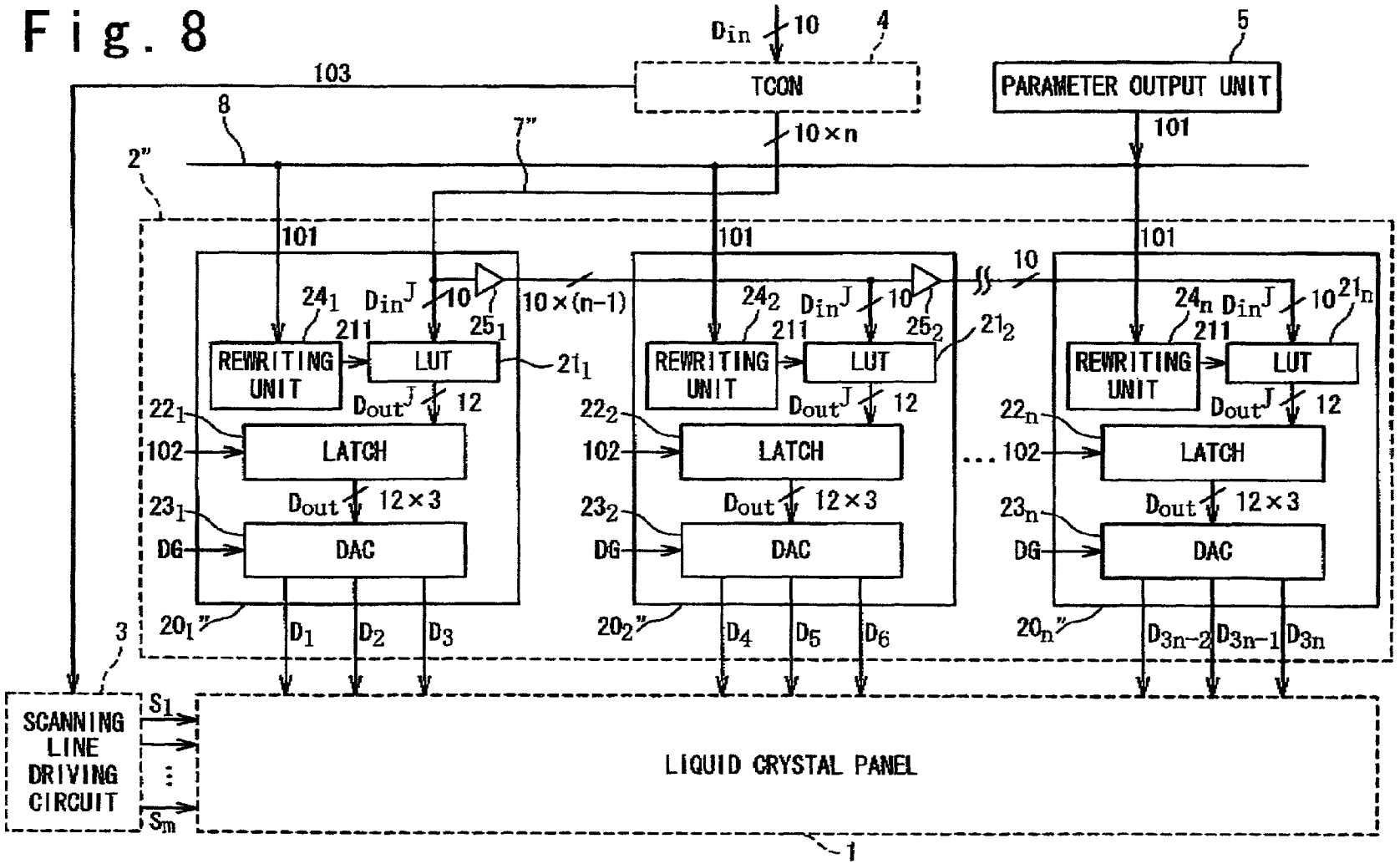
FIG. 8 is a block diagram showing the configuration of a liquid crystal display device according to a fourth embodiment of the present invention.

FIG. 8 is a block diagram showing the configuration of a liquid crystal display device according to a fourth embodiment of the present invention. This configuration is different from the configuration in the first embodiment in the point that the TCON 4 is cascaded to data driver ICs $\mathbf{20}_1$" to $\mathbf{20}_n$" via a bus 7". That is, referring to FIG. 8, the liquid crystal display device has the bus 7" wired between the TCON 4 and a data line driving circuit 2" win place of the bus 7 in the first embodiment, in which the TCON 4 is cascaded to the data driver ICs $\mathbf{20}_1$" to $\mathbf{20}_n$". Referring to FIG. 8, the TCON 4 is connected to the data driver ICs $\mathbf{20}_1$" via the bus 7" with a bus width of 10×n. The data driver ICs $\mathbf{20}_1$" to $\mathbf{20}_{n-1}$" include buffers $\mathbf{25}_1$ to $\mathbf{25}_{n-1}$ respectively that are cascaded by signal lines with a bus width of 10×(n−1) to 10 respectively. For example, the TCON 4 inputs the input gradation signal $D_{in}^j$ of 10×n bits to the data driver IC $\mathbf{20}_1$" via the bus 7". In the data driver IC $\mathbf{20}_2$", the input gradation signal $D_{in}^j$ of 10 bits selected among the supplied input gradation signal $D_{in}^j$ of 10×n bits is supplied to the LUT $\mathbf{21}_1$, and the input gradation signal $D_{in}^j$ of 10×(n-1) bits is outputted to the data driver IC $\mathbf{20}_2$" via the buffer $\mathbf{25}_1$. In the data driver IC $\mathbf{20}_2$", the input gradation signal $D_{in}^j$ of 10 bits selected among the supplied input gradation signal $D_{in}^j$ of 10×(n-1) bits is supplied to the LUT $\mathbf{21}_2$, and the input gradation signal $D_{in}^j$ of 10×(n-2) bits is outputted to the data driver IC$\mathbf{20}_3$" via the buffer $\mathbf{25}_2$. The input gradation signal $D_{in}^j$ of 10 bits is thus inputted to each of the data drivers $\mathbf{20}_1$" to $\mathbf{20}_n$".

The liquid crystal display device in the above configuration is effective in the case of having no space for providing a bus between the TCON 4 and each of the data driver ICs $\mathbf{20}_1$" to $\mathbf{20}_n$". That is, because the data driver IC 20" is cascaded by wiring which utilizes a space in the data line driving circuit 2, the input gradation signal $D_{in}^j$ can be supplied to the entire data driver IC 20" even if there is the data driver IC 20" which can not be wired by the bus 7' from the TCON 4. In the present embodiment, a configuration of excluding the parameter output unit 5 and the bus 8 and replacing the TCON 4 with the TCON 4A described in the second embodiment may also be applied.

5. Fifth Embodiment

Figure 9:
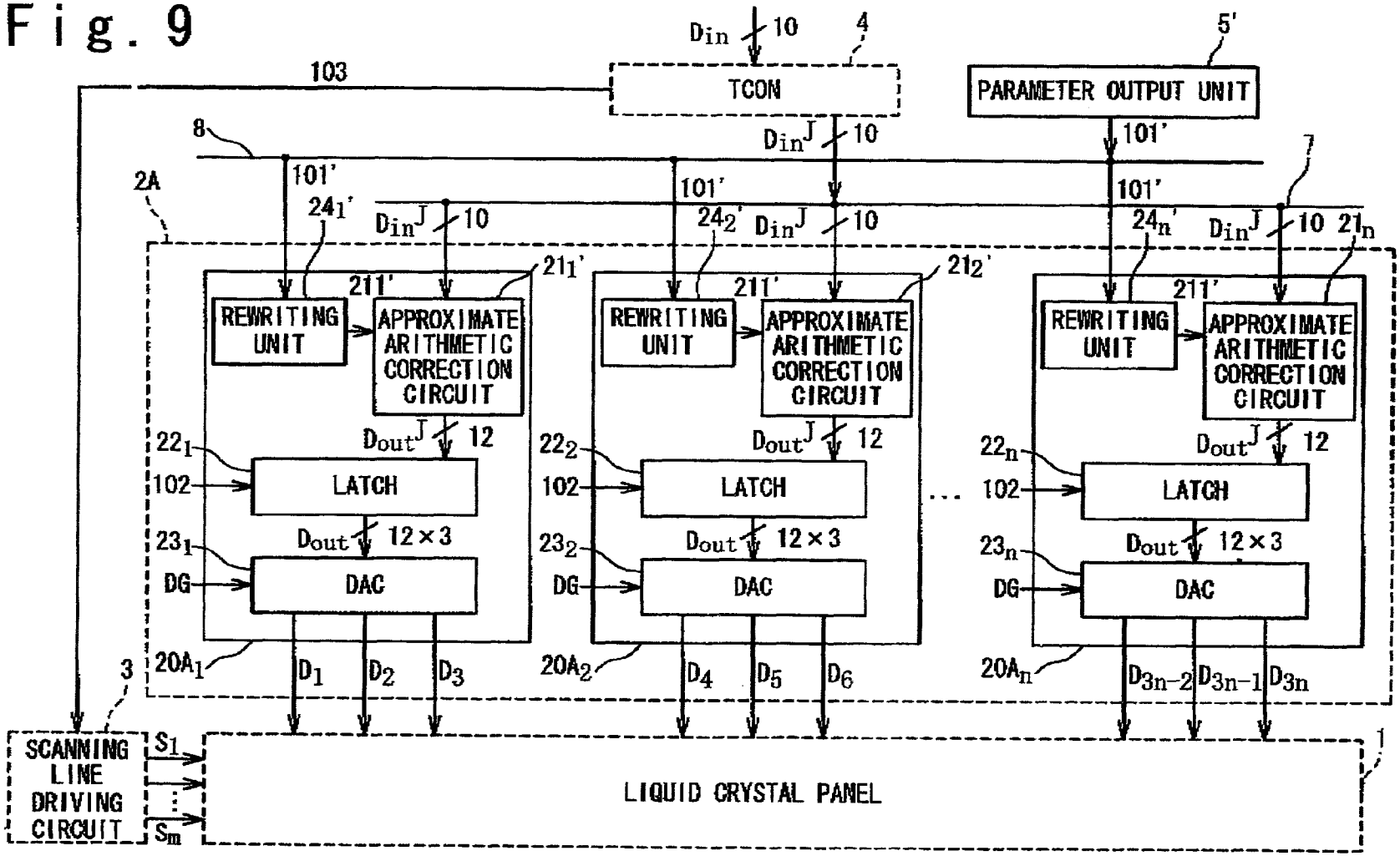
FIG. 9 is a block diagram showing the configuration of a liquid crystal display device according to a fifth embodiment of the present invention.

FIG. 9 is a block diagram showing the configuration of a liquid crystal display device according to a fifth embodiment of the present invention. In the liquid crystal display device in the fifth embodiment, correction of the input gradation signal $D_{in}^j$ is executed by an arithmetic circuit in the data driver. Referring to FIG. 9, the liquid crystal display device in the fifth embodiment includes the data line driving circuit 2A which has approximate arithmetic correction circuit $\mathbf{21}_1$' to $\mathbf{21}_n$' for executing the γ correction by arithmetic with respect to the input gradation signal $D_{in}^j$ to be supplied in place of the LUT $\mathbf{21}_1$ to $\mathbf{21}_n$ in the first embodiment, and includes, in place of the parameter output unit 5 in the first embodiment, a parameter output unit 5' which outputs an arithmetic expression conversion parameter 101' for converting an arithmetic expression of the approximate arithmetic correction circuit 21'.

The data driver 20A in the present embodiment includes a rewriting unit 24', the approximate arithmetic correction circuit 21', the latch 22 and the DAC 23. The approximate arithmetic correction circuit 21' according to the present invention is a linear function arithmetic circuit or a polynomial arithmetic circuit for executing correction by arithmetic using the input gradation signal $D_{in}^j$ as a variable. The approximate arithmetic correction circuit 21' converts the configuration (arithmetic expression) of the arithmetic circuit on the basis of the arithmetic expression setting parameter 101' supplied from the parameter output unit 5'. The input gradation signal $D_{in}^j$ supplied from the TCON 4 is also subjected to arithmetic as a variable for calculating the output gradation signal $D_{out}^j$.

The rewriting unit 24' issues an arithmetic expression change signal 211' which is a control signal for changing a circuit configuration of the approximate arithmetic correction circuit 21' on the basis of the arithmetic expression setting parameter 101' outputted from the parameter output unit 5', so as to change the configuration (arithmetic expression) of the approximate arithmetic correction circuit 21'. The arithmetic expression setting parameter 101 here is a parameter which is set such that the correction curves as shown in FIG. 1A is consistent with the relationship between the input gradation signal $D_{in}^j$ and the result (output gradation signal $D_{out}^j$) from arithmetic of the input gradation signal $D_{in}^j$ as the variable. For example, if the arithmetic expression of the approximate arithmetic correction circuit 21' is polynomial, the result calculated by arithmetic is a coefficient of the polynomial which is set to be consistent with the correction curves. The rewriting unit 24' changes the configuration of the approximate arithmetic correction circuit 21 so as to calculate the output gradation signal $D_{out}^j$ corresponding to the characteristics between the driving voltage and the luminance in the liquid crystal panel based on the arithmetic expression setting parameter described above.

In the forth embodiment, in the cased that bit number of the input gradation signal $D_{in}^j$ subjected to the γ correction is large, the circuit area in the LUT 21 configured by the memory becomes large, which results in the further increase of time required for rewriting the correction data 211. However, in the present embodiment, the γ correction is executed by arithmetic of the approximate arithmetic correction circuit 21', so that the circuit area can be suppressed. The arithmetic expression is also changed by the arithmetic expression setting parameter 101', thereby the time required for the change remain the same regardless of the bit number of the input gradation signal $D_{in}^j$.

6. Sixth Embodiment

Figure 10:
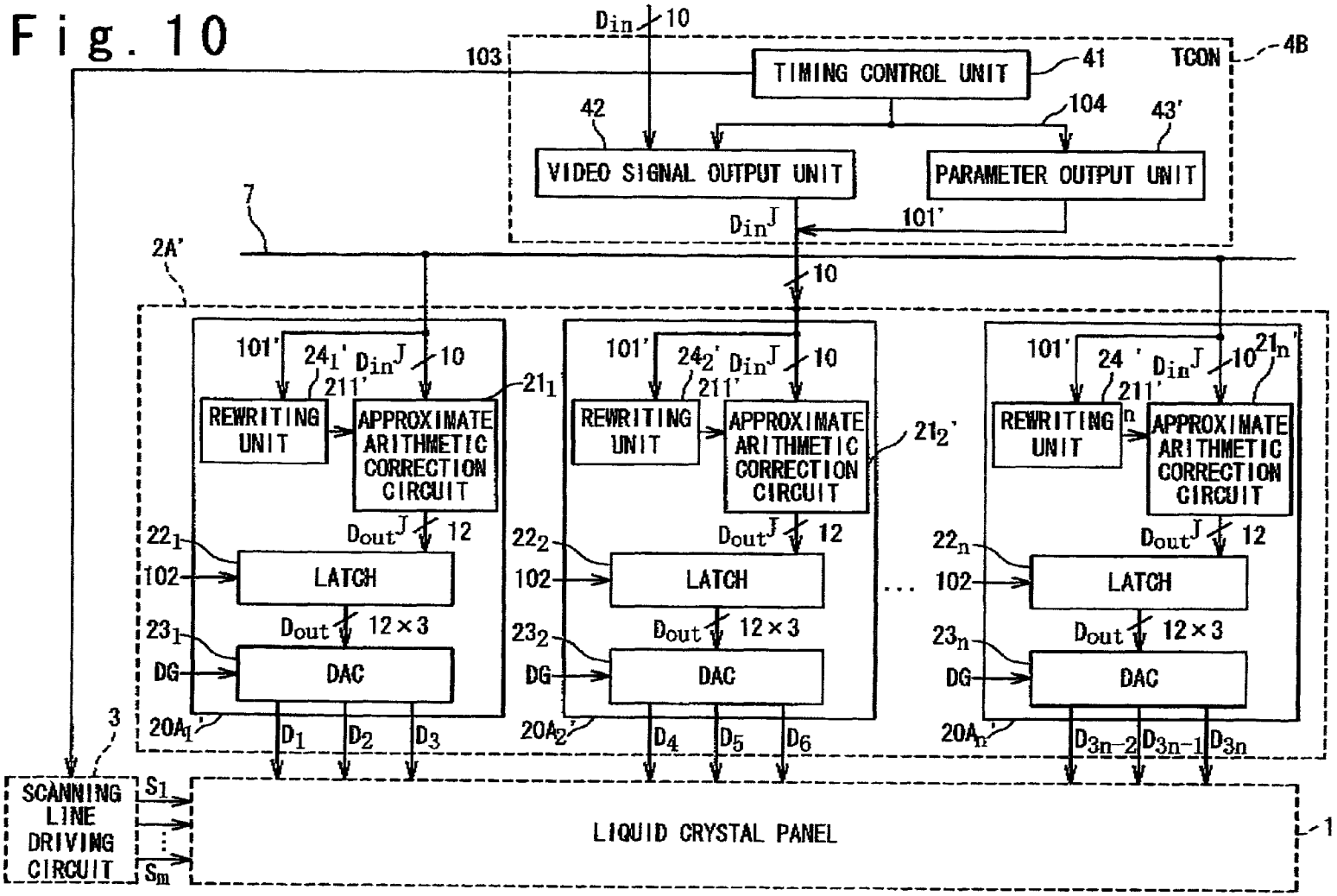
FIG. 10 is a block diagram showing the configuration of a liquid crystal display device according to a sixth embodiment of the present invention.

FIG. 10 is a block diagram showing the configuration of a liquid crystal display device according to a sixth embodiment of the present invention. The liquid crystal display device in the sixth embodiment is configured to have a TCON 4B having a parameter output unit 43' in place of the TCON 4 in the fifth embodiment, in which the bus 8 used for the arithmetic expression setting parameter is not provided. Referring to FIG. 10, the TCON 4B in the sixth embodiment includes the timing control unit 41, the video signal output unit 42, and the parameter output unit 43'. The timing control unit 41 outputs the timing control signal 104 to the video signal output unit 42 and the parameter output unit 43' so as to control the video signal output unit 42 and the parameter output unit 43'. The parameter output unit 43' includes a memory (not shown) for storing the arithmetic expression setting parameter 101', and outputs the arithmetic expression setting parameter 101' in the memory to the data line driving circuit 2A' via the bus 7 in response to the timing control signal 104. In the data driver IC 20A' in the data line driving circuit 2A', the configuration (arithmetic expression) of the approximate arithmetic correction circuit 21' is converted by the supplied arithmetic expression setting parameter 101'.

Referring to FIG. 6, the parameter output unit 43' outputs the arithmetic expression setting parameter 101' in response to the timing control signal 104 in the blanking period of the one horizontal period (1H period). In this way, the parameter output unit 43' is thus controlled by the timing control unit 41 such that the arithmetic expression setting parameter 101' can be outputted in a period in which the input gradation signal $D_{in}^{j}$ is not outputted. Therefore, it is possible to superpose the input gradation signal $D_{in}^{j}$ with the arithmetic expression setting parameter 101' for being transferred to the data line driving circuit 2 via the bus 7.

Due to the above configuration, in the data driver IC 20A' in the data line driving circuit 2A' in the present embodiment, the configuration of the approximate arithmetic correction circuit 21' can be changed by the arithmetic expression setting parameter 101' supplied via the same bus 7. Therefore, the number of the bus lines can be decreased in comparison with the fifth embodiment. The parameter output unit 43' provided in the TCON 4B so as to enable the circuit area of the liquid crystal display device in the sixth embodiment to be further decreased in comparison with the fifth embodiment. Furthermore, since the arithmetic expression of the approximate arithmetic correction circuit 21' can be changed in each horizontal period, the γ correction can be executed by arithmetic using the optimum arithmetic expression in each one line. Meanwhile, the timing control unit 41 selectively controls a pixel driven by outputting the scanning line control signal 103 with respect to the scanning line driving circuit 3. At this time, the parameter output unit 43' outputs the arithmetic expression setting parameter 101' in response to the timing control signal 104 corresponding to the scanning line control signal 103. Therefore, the arithmetic expression setting parameter 101*f* can be outputted in the blanking period of the vertical period. That is, the γ correction can be executed by changing the optimum correction data 211 in each flame.

7. Seventh Embodiment

Figure 11:
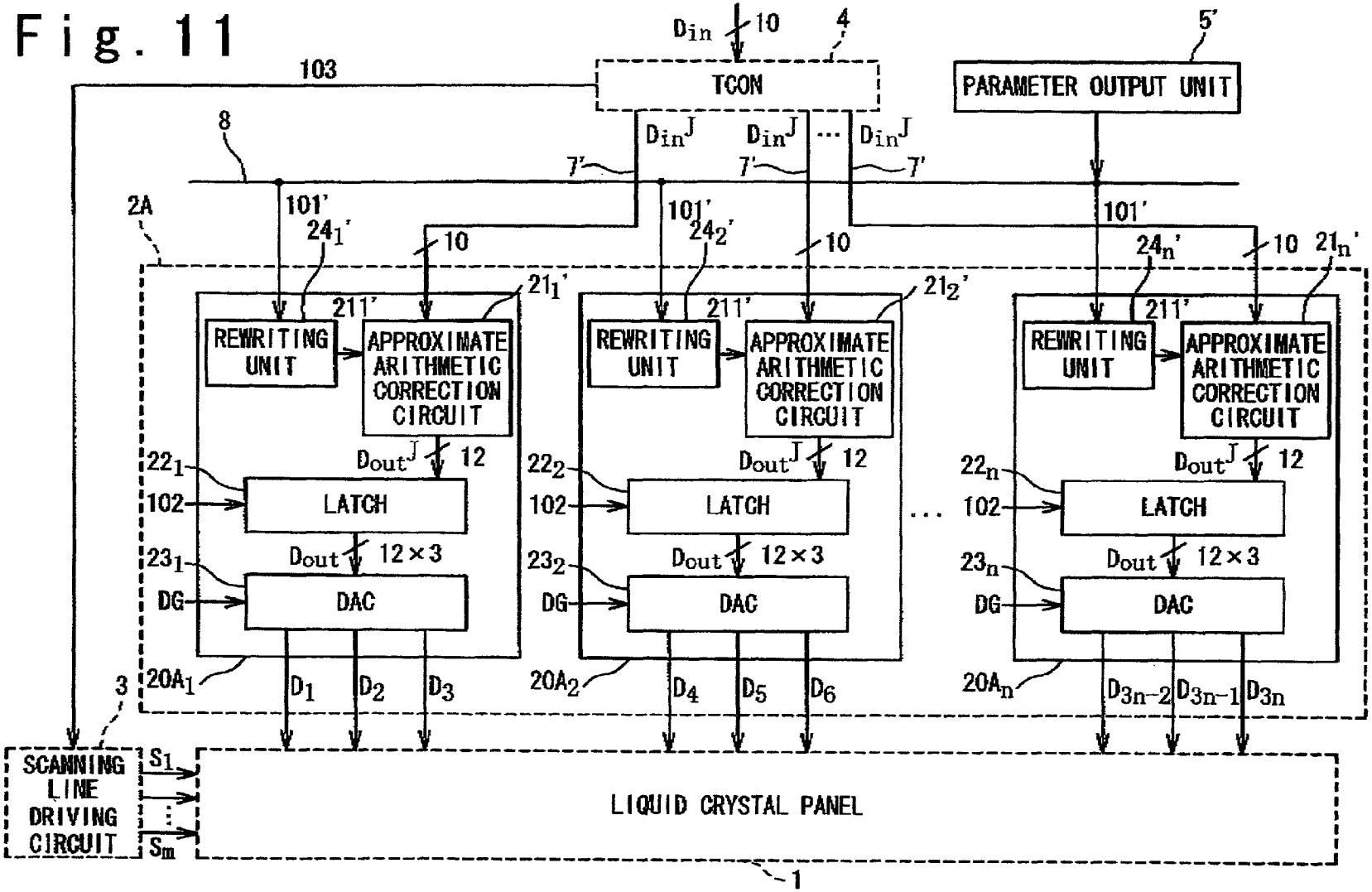
FIG. 11 is a block diagram showing the configuration of a liquid crystal display device according to a seventh embodiment of the present invention.

FIG. 11 is a block diagram showing the configuration of a liquid crystal display device according to a seventh embodiment of the present invention. This configuration is different from that of the fifth embodiment in the point that the TCON 4 is connected to data driver ICs 20$A_l$ to 20$A_n$ in one-to-one correspondence by using the bus 7'. That is, referring to FIG. 11, the liquid crystal display device according to the present invention is configured to have the bus 7' wired between the TCON 4 and each of the data driver ICs 20$A_1$ to 20$A_n$ in one-to-one correspondence in place of the bus 7 in the fifth embodiment. Due to this configuration, the TCON 4 is capable of outputting the input video signal $D_{in}^{j}$ to each of the data driver ICs 20$A_l$ to 20$A_n$ simultaneously. Therefore, the data processing time spent for one data driver IC 20A can be extended. In the present embodiment, a configuration of excluding the parameter output unit 5' and the bus 8 and replacing the TCON 4 with the TCON 4B described in the sixth embodiment may also be applied.

8. Eighth Embodiment

Figure 12:
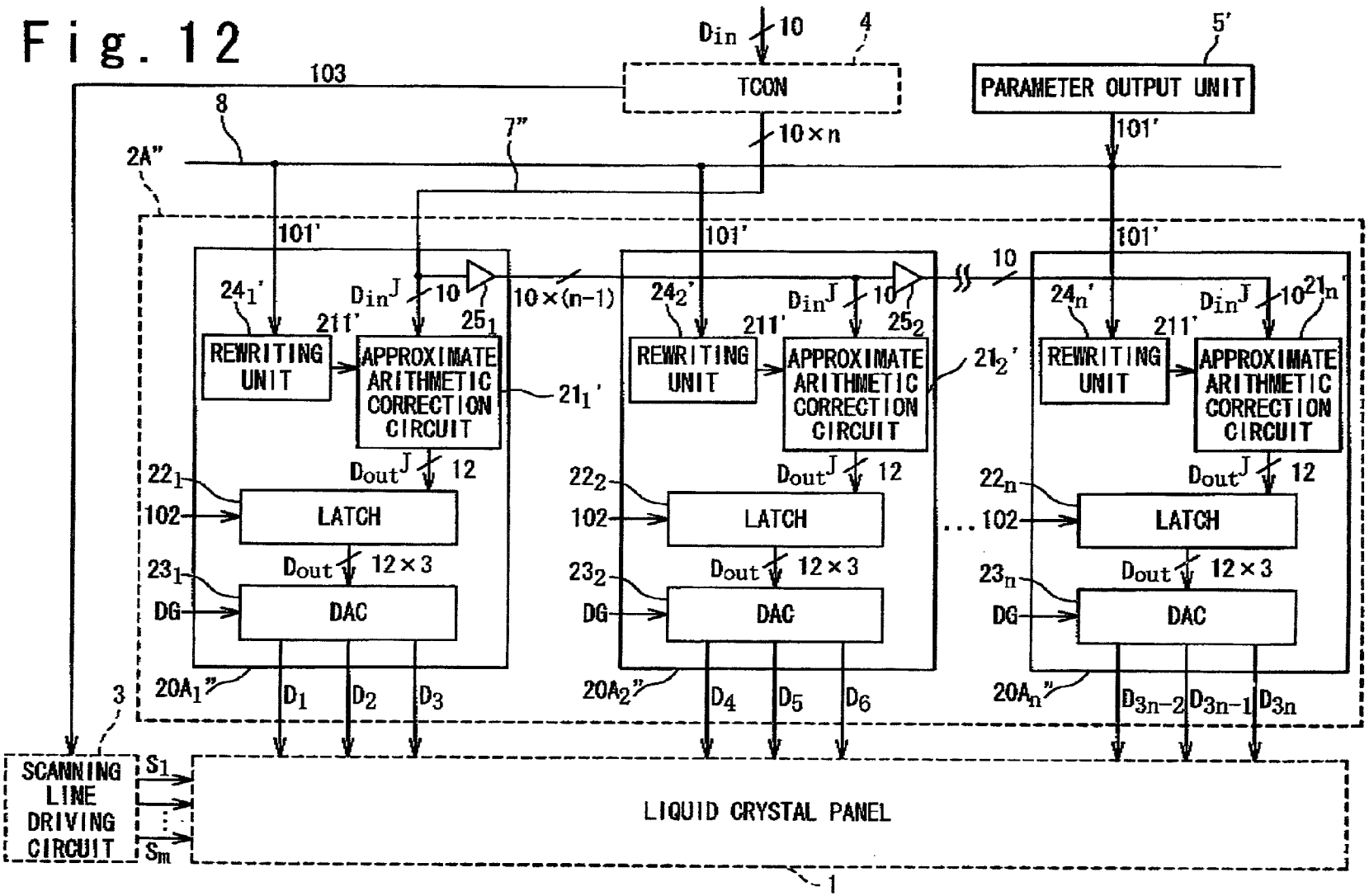
FIG. 12 is a block diagram showing the configuration of a liquid crystal display device according to an eighth embodiment of the present invention.

FIG. 12 is a block diagram showing the configuration of a liquid crystal display device according to an eighth embodiment of the present inventions. This configuration is different from that of the fifth embodiment in the point that the TCON 4 is cascaded to data driver ICs 20$A_l$" to 20$A_n$" via the bus 7". That is, referring to FIG. 12, the liquid crystal display device has the bus 7" wired between the TCON 4 and a data line driving circuit 2A" in place of the bus 7 in the fifth embodiment, in which the TCON 4 is cascaded to the data driver ICs 20$A_l$" to 20$A_n$". In the present embodiment, the data driver ICs 20$A_1$" to 20$A_n$" are connected to the TCON 4 via the bus 7" with a bus width of 10×n. The data driver ICs 20$A_l$" to 20$A_{n-1}$" respectively include buffers 25$_l$ to 25$_{n-1}$ that are cascaded by the signal lines with the bus width of 10×(n−1) to 10. Because an embodiment for connection is the same with the cascade connection described above, explanation thereof will be omitted.

In the liquid crystal display device with the above configuration, the data driver IC 20A" is subjected to the cascade connection by wiring which utilizes a space in the data line driving circuit 2A", thereby the input gradation signal $D_{in}^{j}$ can be supplied to the entire data driver IC 20A" even if there is the data driver IC 20A" which can not be wired by the bus 7 from the TCON 4. In the present embodiment, a configuration excluding the parameter output unit 5 and the bus 8 and replacing the TCON 4 with TCON 4B described in the sixth embodiment may be applied.

Moreover, as shown in FIG. 1A, due to the difference of the correction curves made by the respective R, G and B colors, it is preferable in the data driver IC 20A according to the fifth embodiment to provide the approximate arithmetic correction circuit 21' for conducting correction arithmetic by corresponding to each of the R, G and B colors. In this case, the arithmetic expression setting parameter 101' preferably includes identification information corresponding to each of the R, G and B colors so that the approximate arithmetic correction circuit 21' made different by the respective colors can be selected. As described above, the approximate arithmetic correction circuit 21' corresponding to each of the R, G and B colors is provided in the data driver IC 20" according to the present embodiment, thereby the γ correction can be executed in accordance with the characteristics between the driving voltage and the luminance in the liquid crystal panel 1 that are made different by the respective colors of the input gradation signal $D_{in}^{j}$. Moreover, the γ correction executed for each of the R, G and B colors enables more detailed corrections, which realizes the video display with high color reproduction.

As described above, explanations were made for the details of the embodiments of the present inventions. However, a concrete configuration is not limited to the above embodiments, and changes made to the extent not deviating from the outline of the present invention may be included in the present invention. In the present embodiments, the data line driving signal $D_{out}$ is obtained by using the DAC 23, but a linear DAC 23' for converting the output gradation signal $D_{out}^{j}$ to the data line driving signal $D_{out}$ of an analog signal can also be utilized in place of the DAC 23. If the linear DAC 23 is used, the LUT 21 needs to convert the input gradation signal $D_{in}^{j}$ to the output gradation signal $D_{out}$ with a large bit number, which means that application of the present invention is effective. In the present embodiments, explanations were made using the liquid crystal display device as an example of the display device, but other matrix type display devices such as an organic EL display device or the like may also be applied.

According to the present invention, it is possible to provide a display device capable of selecting the optimum γ correction in accordance with the characteristics between the driving voltage and the luminance in a display panel. A substrate area and a manufacturing cost of the display device can also be reduced.

Further, it can be possible to reduce the power consumption of the display device. Electro magnetic interference (EMI) in the display device can also be reduced.

It is apparent that the present invention is not limited to the above embodiment that may be modified and changed without departing from the scope and spirit of the invention.

What is claimed is:

1. A display device comprising:

a display panel;

a data line driving circuit configured to drive data lines on said display panel;

a timing control unit configured to output an input gradation signal based on an image signal from outside to said data line driving circuit at a predetermined timing; and a parameter output unit configured to output a conversion parameter for executing gamma correction corresponding to characteristics between a driving voltage and a luminance of said display panel, wherein said data line driving circuit includes:

a correction circuit configured to convert said input gradation signal to an output gradation signal based on said conversion parameter, and output said output gradation signal, and a digital-to-analog conversion circuit configured to convert said output gradation signal outputted from said correction circuit to a data line driving signal of an analog signal, and drive said data lines, wherein said data line driving circuit and said timing control unit are connected through a first bus, wherein said timing control unit outputs said input gradation signal to said data line driving circuit through said first bus, and wherein said parameter output unit outputs said conversion parameter to said data line driving circuit through said first bus, in a blanking period when said timing control unit does not output said input gradation signal.

2. The display device according to claim 1, wherein said parameter output unit outputs said conversion parameter to said data line driving circuit in said blanking period of a horizontal period.

3. The display device according to claim 1, wherein said parameter output unit outputs said conversion parameter to said data line driving circuit in said blanking period of a vertical period.

4. The display device according to claim 1, wherein said data line driving circuit includes:

a plurality of data driver ICs, wherein each of said plurality of data driver ICs includes:

said correction circuit, and said digital-to-analog conversion circuit, wherein said first bus includes a plurality of buses, each of which connects said each of the plurality of data driver ICs and said timing control unit in one-to-one correspondence.

* * * * *